US006289811B1

(12) United States Patent
Du Pont

(10) Patent No.: US 6,289,811 B1
(45) Date of Patent: Sep. 18, 2001

(54) METHOD AND APPARATUS FOR SAMPLING AND INSPECTING INK FOR A PRINTING PRESS

(75) Inventor: John Du Pont, Suamico, WI (US)

(73) Assignee: Paper Converting Machine Co., Green Bay, WI (US)

( * ) Notice: Subject to any disclaimer, the term of this patent is extended or adjusted under 35 U.S.C. 154(b) by 0 days.

(21) Appl. No.: 09/481,105

(22) Filed: Jan. 11, 2000

(51) Int. Cl.[7] ..... B41F 1/34; B41L 15/14; B41L 49/00; B41L 5/16; B41M 1/14

(52) U.S. Cl. ..... 101/480; 101/479; 101/207; 101/211; 101/350.2

(58) Field of Search ..... 101/154, 480, 101/485, 494, 425, 479, 350.5, 350.6, 352.11, 352.13, 475, 350.2, 207, 211

(56) References Cited

U.S. PATENT DOCUMENTS

| | | | | |
|---|---|---|---|---|
| 4,199,289 | | 4/1980 | Segbert . | |
| 4,462,311 | | 7/1984 | Armelin . | |
| 5,010,813 | * | 4/1991 | Buffo | 101/178 |
| 5,060,569 | | 10/1991 | Gladow . | |
| 5,072,525 | * | 12/1991 | Philpot et al. | 101/DIG. 36 |
| 5,099,759 | * | 3/1992 | Sonobe et al. | 101/348 |
| 5,570,633 | | 11/1996 | Schultz . | |
| 6,038,972 | | 2/2000 | Delwiche et al. . | |
| 6,038,977 | * | 3/2000 | Haney et al. | 101/490 |

FOREIGN PATENT DOCUMENTS

| | | |
|---|---|---|
| 0325445 | 1/1989 | (EP) . |
| 0498012A1 | 2/1991 | (EP) . |
| 0464309 B1 | 3/1991 | (EP) . |

OTHER PUBLICATIONS

Catalog page for Star Linear Module.
9/97 Advertisement for Ink–Master Device.

* cited by examiner

*Primary Examiner*—Kimberly L. Asher

(57) ABSTRACT

A sample of printing ink for a printing press is obtained using actual press components. An anilox roll for the press is supplied with ink and is rotated while the anilox roll is either mounted on the press or mounted off-line from the press. A printable substrate is printed with the ink either by pressing the substrate directly against the anilox roll or by pressing a transfer roll against the anilox roll and pressing the substrate against the transfer roll. The ink on the substrate is inspected, and any necessary changes to the ink are made before the press run is started.

4 Claims, 14 Drawing Sheets

METHOD AND APPARATUS FOR SAMPLING AND INSPECTING INK FOR A PRINTING PRESS

BACKGROUND

This invention relates to measuring and adjusting ink for a printing press. More particularly, the invention permits ink color to be inspected and adjusted using actual press components before the press run is started.

Various physical properties of printing ink, such as balance, density, and hue, are contributing factors to the success of the printed product. Obtaining proper physical properties for a particular press run is usually a time-consuming process. The printing industry needs the ability to rapidly, scientifically, and correctly obtain the proper color match.

The process of measuring and adjusting ink is conventionally performed within an ink mixing department at a location off of the press and without actual press components. At the start of the job run, additional measurements and adjustments must be made on the press. This is costly in terms of the time the press remains idle while the measurements are performed and ink adjustments are made.

One prior art device is available for sampling ink and for printing the ink on a piece of paper. However, the ink is not sampled from the actual anilox roll which will be used on the press. Instead a pseudo anilox roll is used. The pseudo anilox roll is a small roll with surface characteristics which are similar to those of an actual anilox roll. The pseudo roll is nipped with a rubber roll to meter the ink and does not use the doctor blade metering system of a real anilox roll. The device is typically used to roll a sample of ink onto a piece of paper rather than the actual substrate which is printed in the press.

Since the ink sample is obtained and printed without using actual press components, the ink sample will not necessarily be an accurate representation of the ink which will be printed by the press. Accordingly, additional measurements and adjustments must be made on the press during the start-up of the actual print run.

SUMMARY OF THE INVENTION

The invention permits the press operator or ink technician to achieve correct ink balance, density, hue, etc. within a press deck or of off the press rather than in the mixing department. The anilox roll assembly for the next press run can be prepared off-press, for example, in a staging area if the press includes a staging area. The anilox roll assembly includes the actual anilox roll and doctor blade metering system which will be used on the press within a particular press run. A conventional Sunday drive or auxiliary drive rotates the anilox roll to maintain the anilox roll wetted with ink.

A hand-held ink sampling device includes a frame, a handle, and an impression roll and a transfer roll which are rotatably mounted in the frame. A sample of the actual substrate which will be printed on the press is cut from the substrate and taped to the removable impression roll. The transfer roll is pressed against the rotating anilox roll and is caused to rotate by the anilox roll. Rotation of the transfer roll causes the impression roll to rotate and feeds the substrate between the two rotating rolls. Ink is transferred from the anilox roll to the transfer roll and then to the substrate. The ink which is printed on the substrate can be inspected for hue, density, etc., and any desired changes to the ink can be made off-press before the anilox roll assembly is transferred to the press The device can also be used with presses which are not equipped with a staging structure and carriages. On this type of press the inks can be checked in the press before starting production.

DESCRIPTION OF THE DRAWING

The invention will be explained in conjunction with the illustrative embodiments shown in the accompanying drawing, in which.

DESCRIPTION OF SPECIFIC EMBODIMENTS

The invention will be explained in conjunction with a flexographic printing press which uses an anilox roll to transfer printing ink from an ink fountain or doctor blade to a printing plate roll which prints an image on a web or substrate. However, it will be understood that the invention can be used with other types of presses and with inking rolls other than anilox rolls such as a coating roll. As used herein, the term "anilox roll" refers broadly to an engraved roll of a press which is used to transfer ink from one area or component of the press to another.

Figure 1:
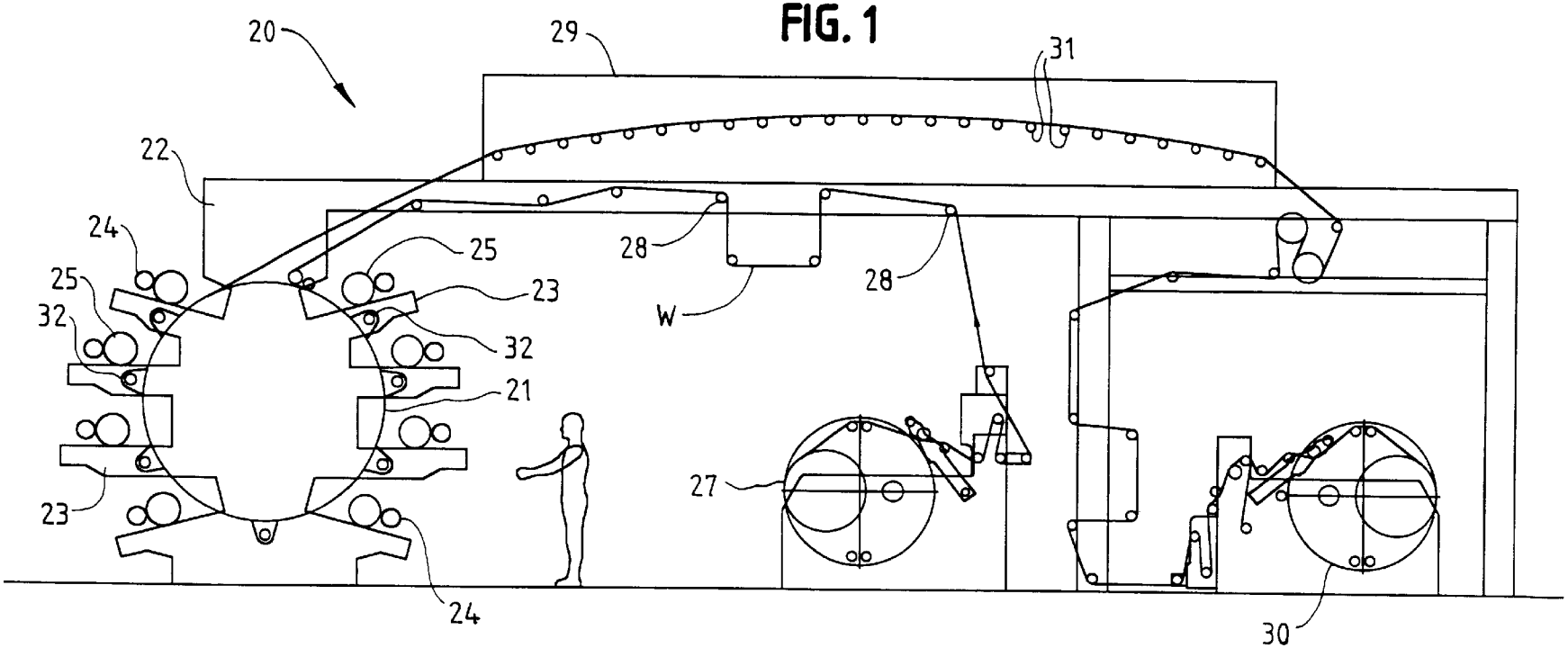
FIG. 1 is a side elevational view of a conventional flexographic printing press.

FIG. 1 illustrates a conventional flexographic press 10 which includes a pair of side frames 11 and a central impression cylinder 12 which is rotatably mounted on the side frames for rotation about an axis 13. A plurality of color decks 14 are mounted around the central impression cylinder, and each color deck includes a plate roll 15 and an anilox roll 16.

A web W is unwound from an unwind 17 and wraps the central impression cylinder for rotation therewith. As the web rotates with the central impression cylinder, each of the plate rolls prints an image on the web. Between-color dryers 18 are mounted between adjacent color decks, and the printed web travels through tunnel dryer 19 to a rewinder 20.

Figure 2:
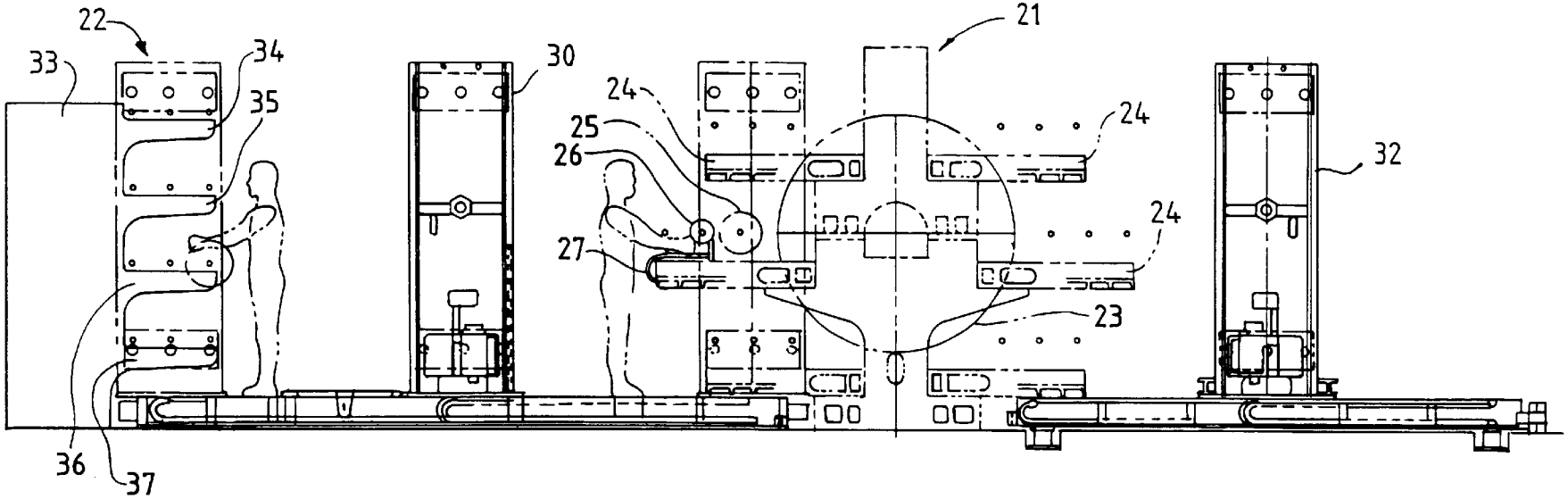
FIG. 2 is a side elevational view of a flexographic press and a staging area for storing and preparing press components.

FIG. 2 illustrates a similar flexographic press 21 and a staging area or make ready area 22 where components of the color decks for the next run of the press are prepared while the press is printing the current run.

The press 21 similarly includes a central impression cylinder 23 and color decks 24. Each of the color decks supports a plate roll 25, an anilox roll 26, and a color deck carriage 27. The color deck carriage includes the ink system for the press.

The plate rolls and anilox rolls are shown in their racked-out, non-operating positions in FIGS. 1 and 2. When the press is operating, the plate rolls are adjacent the surface of the central impression cylinder, and the anilox rolls contact the printing plates on the plate rolls. Ink is thereby transferred to the plates, and images are transferred to the web or substrate.

The plate rolls, anilox rolls, and color deck carriages are removably mounted on the press, and the components on the left side of the press can be moved from the press to the staging area 22 by a robot 30. The components on the right side of the press can be moved to a second staging area by robot 32. The robots and the procedure for transferring components between the press and the staging area is described in co-owned pending United States patent application entitled "Quick Change System for a Press," Ser. No. 09/222,210, filed Dec. 29, 1998, now U.S. Pat. No. 6,038,972.

Figure 3:
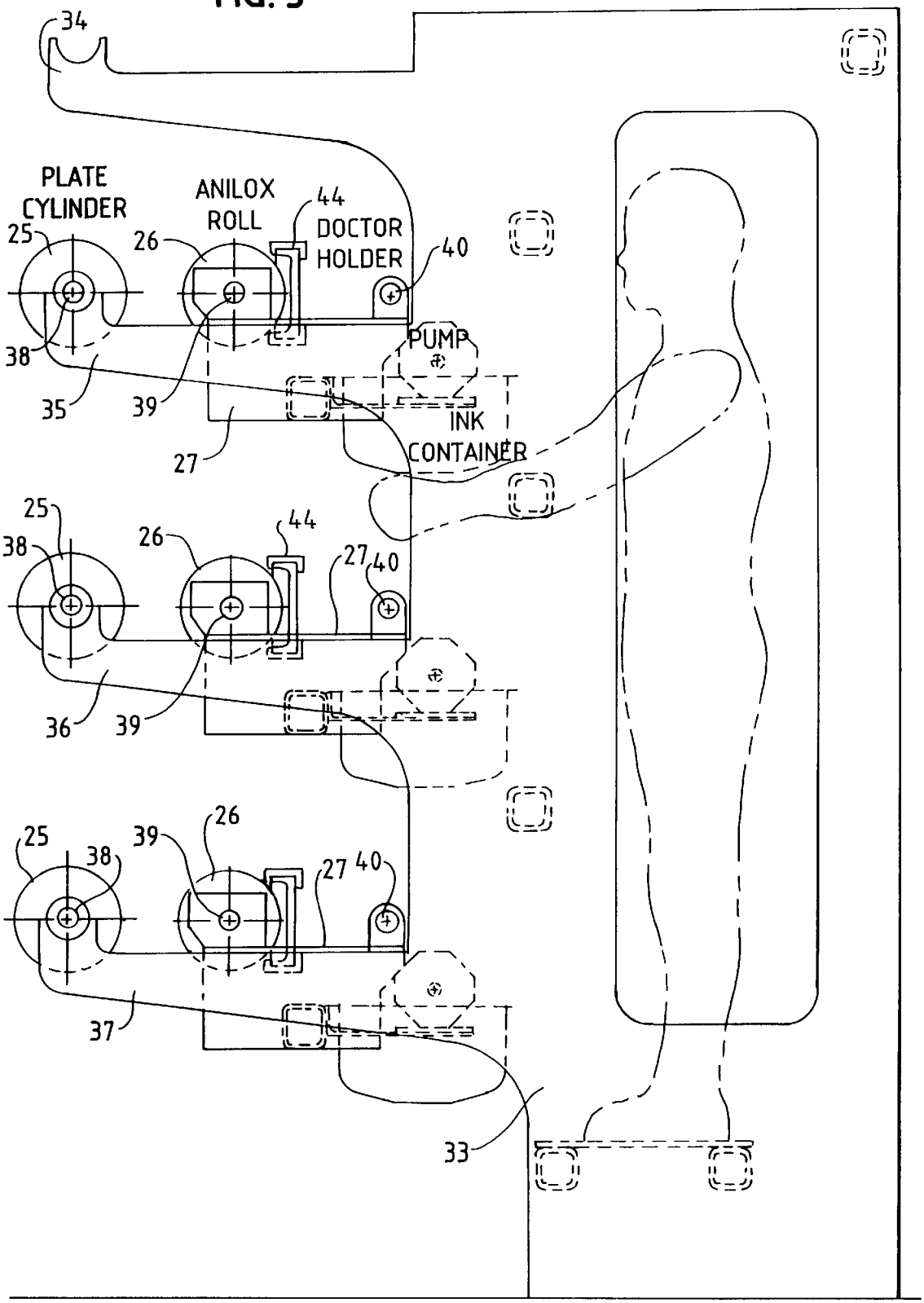
FIG. 3 is an enlarged side elevational view of the staging area.

The staging area includes a pair of support frames 33, and each support frame includes four support decks 34–37. Referring to FIG. 3, each of the support decks can support a plate roll 25, an anilox roll 26, and a color deck carriage 27 from one of the color decks of the press. Each plate roll includes a pair of laterally extending journals 38 which are supported by the support frames 33. Similarly, the anilox rolls include journals 39 (see also FIG. 4), and the color deck carriages include non-rotating dead journals 40 which are also supported by the support frames 33.

The plate cylinder journals 38 and anilox roll journals 39 can be rotatably and removably mounted on the frame of the flexographic press in the conventional manner by bearing caps or journal caps. The non-rotating journals 40 of the color deck carriages are not supported in the color deck of the press. The carriage is supported by the frame of the press, but essentially "floats" so that any inconsistencies of manufacturing of the carriage do not result in misalignment within the press.

Figure 4:
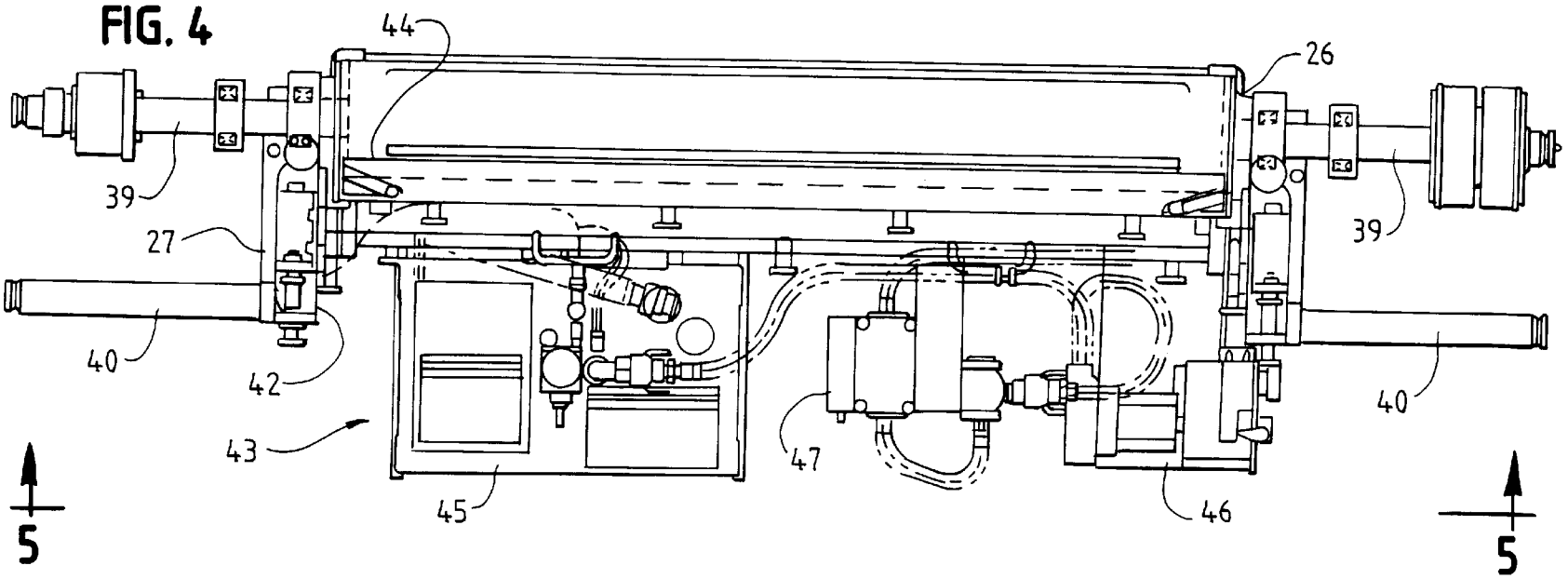
FIG. 4 is a top view of the color deck carriage of one of the color decks of the press.
Figure 5:
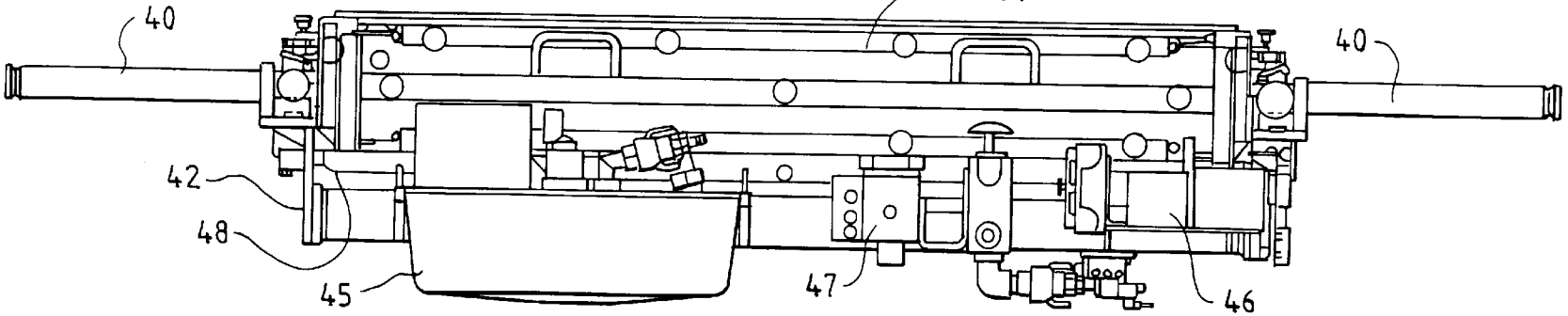
FIG. 5 is a view taken along the line 5—5 of FIG. 4.
Figure 6:
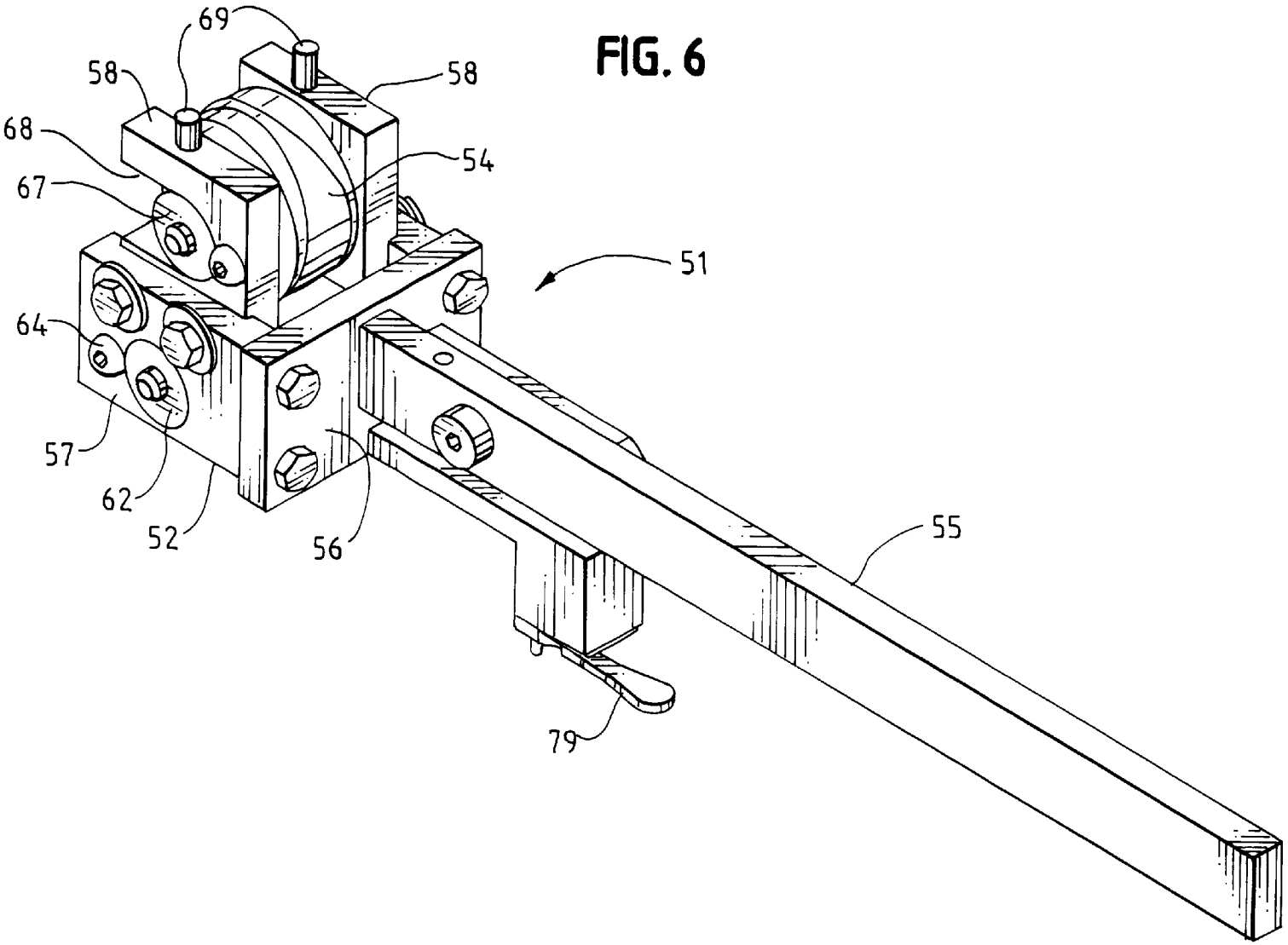
FIG. 6 is a rear perspective view of an ink sampling device which is formed in accordance with the invention.

Referring to FIGS. 4 and 5, each of the color deck carriages 27 includes a frame 42 for supporting an anilox roll 26 and an ink handling system 43 for a single color deck. The ink handling system 43 includes a doctor blade assembly 44, an ink container 45, a pump 46, a viscosity control system 47, a drip containment pan 48, and required hoses and piping. Such components are well known, and a detailed description is unnecessary.

The carriage 27 is independent of the press and provides a totally integrated ink delivery system. The entire carriage, including the anilox roll 26, is transported between the staging area 22 and the press 21.

The staging framework is equipped with a conventional Sunday drive system or auxiliary drive which will provide the anilox roll rotation necessary for ink-up purposes. When the time arrives for ink-up, this system is activated. Color swatch samples can be taken, and make-ready personnel can make whatever ink and setting changes are required to achieve the desired printing parameters. The staging framework 33 also includes the motor required for the ink pump. The carriage 27 contains the pump heads. Like the framework, the press includes a Sunday drive and the motor for the ink pump permanently mounted on it.

The invention facilitates achieving correct ink balance, density, hue, etc. while the anilox roll and the ink handling system are mounted either on the press or off-press in the staging area. Referring to FIGS. 6–9, an ink sampling device 51 is used to transfer an ink sample from an anilox roll to a piece of the web or substrate which is cut from the actual web or substrate which will be printed in the press.

The device 51 includes a generally U-shaped frame 52 and a plate roll or transfer roll 53 and an impression roll 54 which are rotatably mounted in the frame. A handle 55 is attached to the frame to enable the operator to press the plate roll against an anilox roll while the anilox roll is rotated by the Sunday drive.

The frame 52 includes an end plate 56 and a pair of side plates 57 which are bolted to the end plate. An upper plate 58 is bolted to each of the side plates.

The plate roll 53 includes a cylindrical outer surface 60 and a pair of journals 61. Each journal is rotatably mounted in a bearing 62 which is mounted in an opening 63 in one of the side plates 57. Each of the bearings 62 is prevented from moving axially by the head of a screw 64.

The impression roll 54 includes an outer cylindrical surface 65 and a pair of journals 66. Each journal is rotatably mounted in a bearing 67 which is positioned in a slot 68 in one of the upper plates 58. A plunger spring 69 extends into a top opening 70 in each of the top plates 58 and engages one of the bearings 67 outside of the center of the bearing to retain the bearing in the slot. Each of the bearings 67 is prevented from moving axially by the head of a screw 71.

The plunger springs 69 are conventional, commercially available devices. Each plunger spring includes a plunger which is reciprocably mounted within an externally threaded tube and a compression spring inside of the tube which resiliently biases the plunger toward the open end of the tube. The impression roll can be removed from the slots 68 in the frame by exerting enough force on the roll to force the plungers of the plunger springs upwardly and to move the bearings 67 past the plungers.

The plate roll 53 is covered with a compliant material 72, for example, Buna-N rubber, vinyl, photopolymer, etc. which preferably has the same composition and durometer as a printing plate of a flexographic press and simulates the ink-carrying and split capability of the plates.

Figure 7:
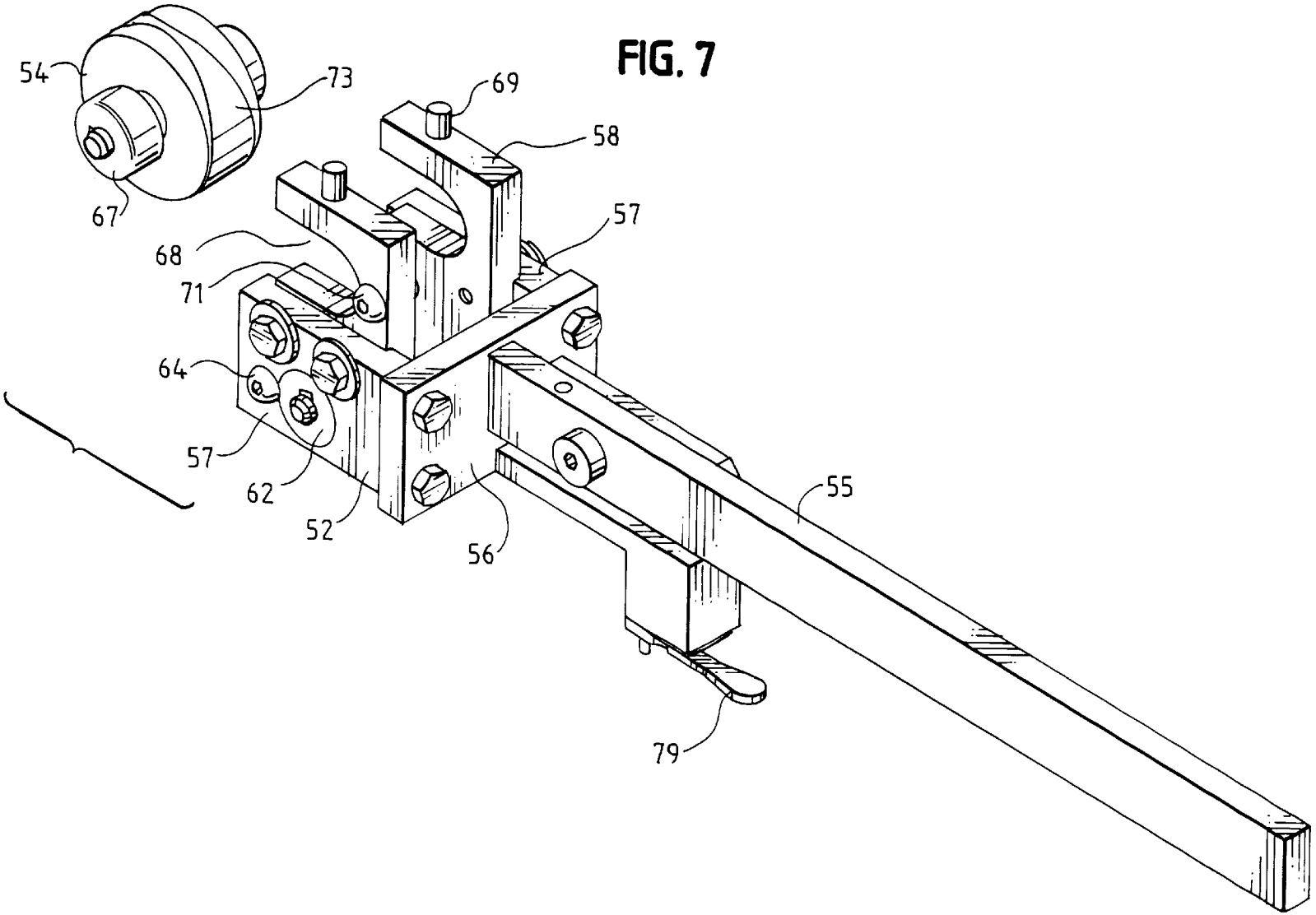
FIG. 7 is a partially exploded view of the device of FIG. 6.
Figure 8:
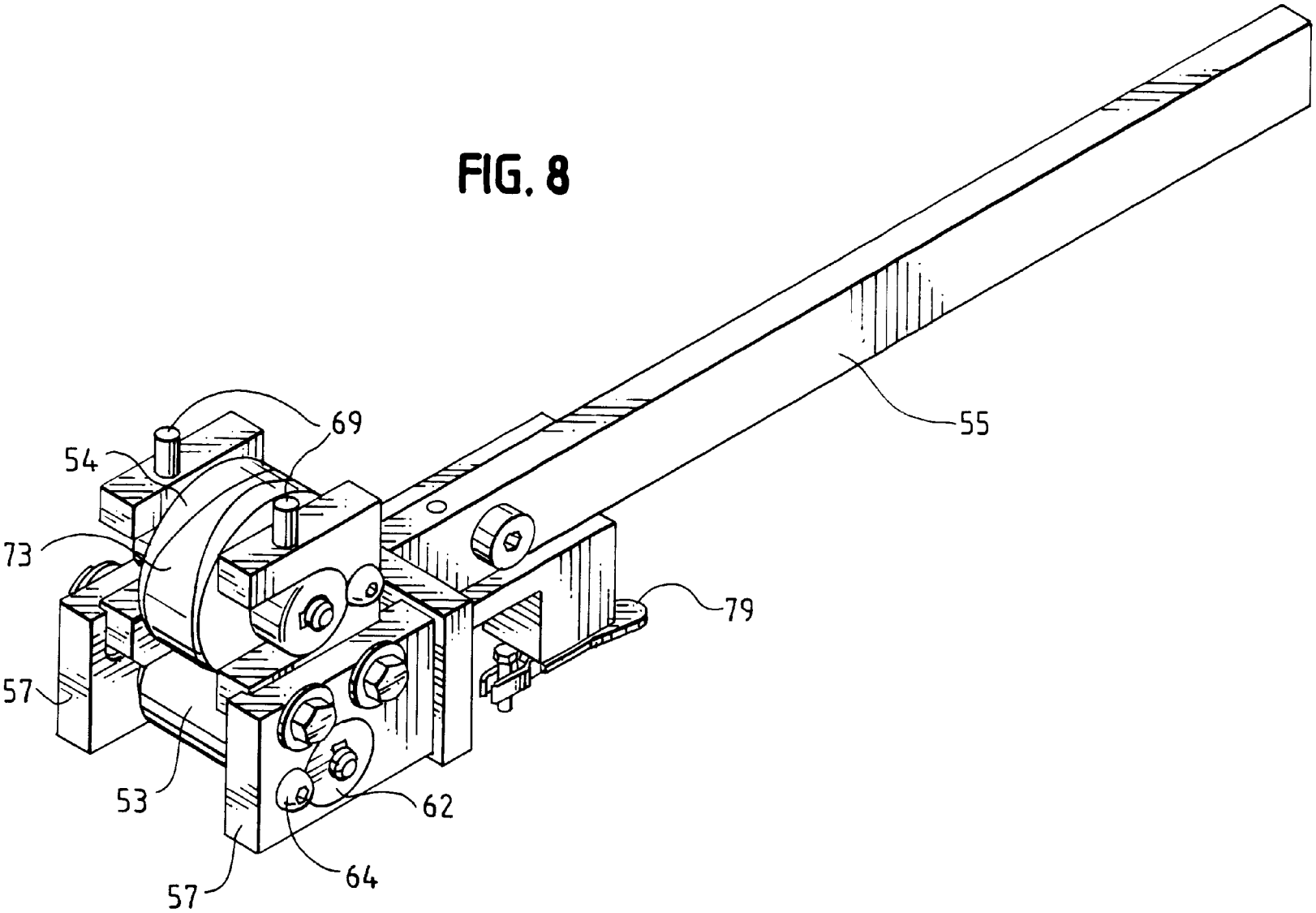
FIG. 8 is a front perspective view of the device of FIG. 6.
Figure 9:
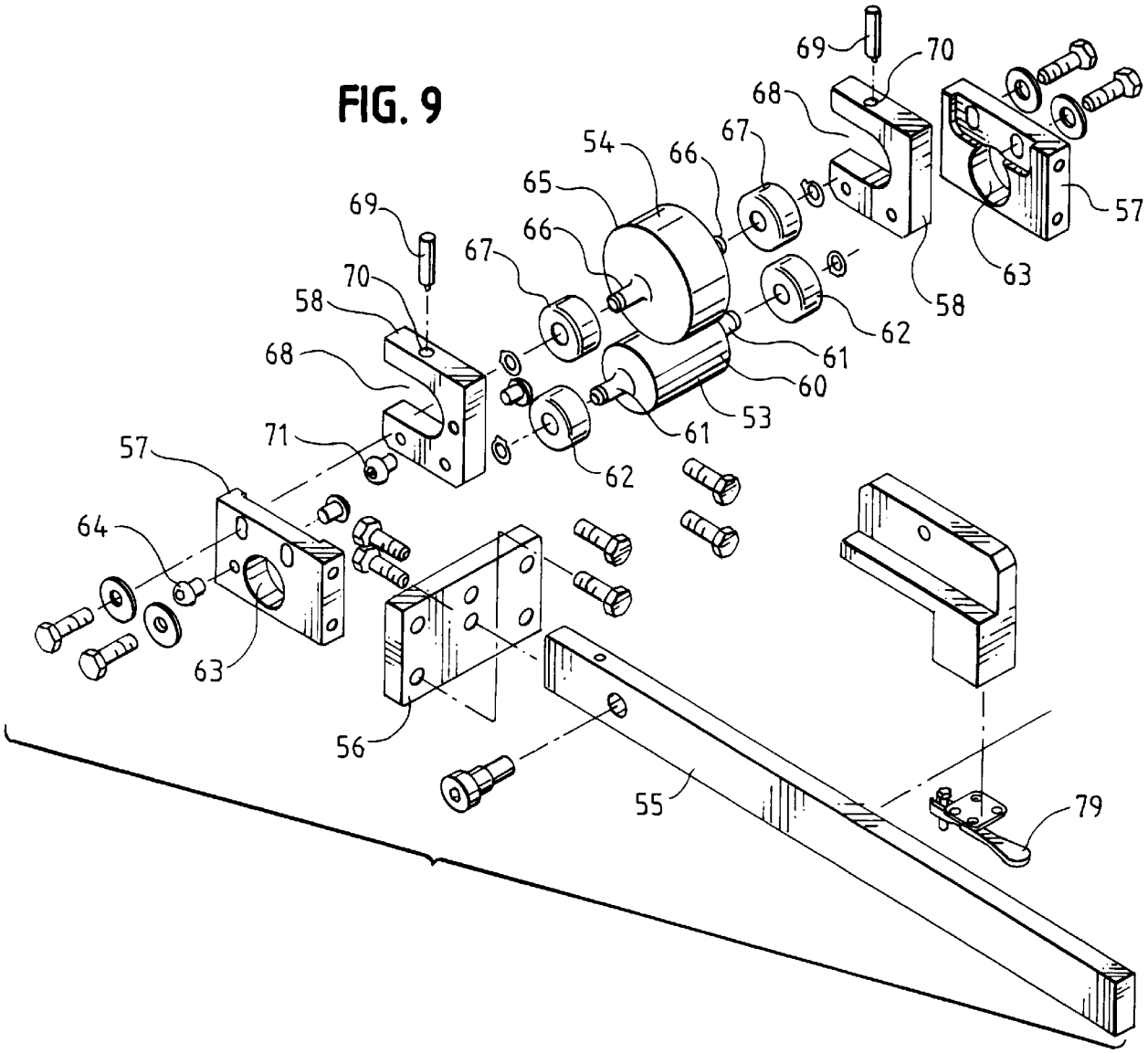
FIG. 9 is an exploded perspective view of the device of FIG. 6.
Figure 13:
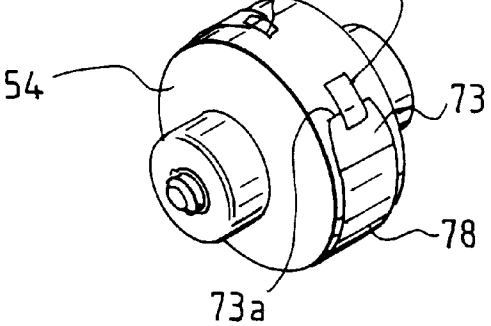
FIG. 13 is a perspective view of the impression roll after ink is printed onto the substrate.

Referring to FIG. 7, a strip 73 of the web material or substrate which will be printed in the press is cut from the web and wrapped around the outer surface of the impression roll. The strip 73 advantageously wraps around most of the impression roll, and the ends 73 of the strip are secured to the impression roll by tape 74 (FIG. 13). In the embodiment illustrated, the strip 73 extends for about 300° around the impression roll.

The strip 73 contacts the outer surface of the plate roll 53 in the nip between the plate roll 53 and the impression roll 54. The clearance at the nip is such that the strip is frictionally engaged by the plate roll so that rotation of the plate roll rotates the strip and the impression roll.

Figure 10:
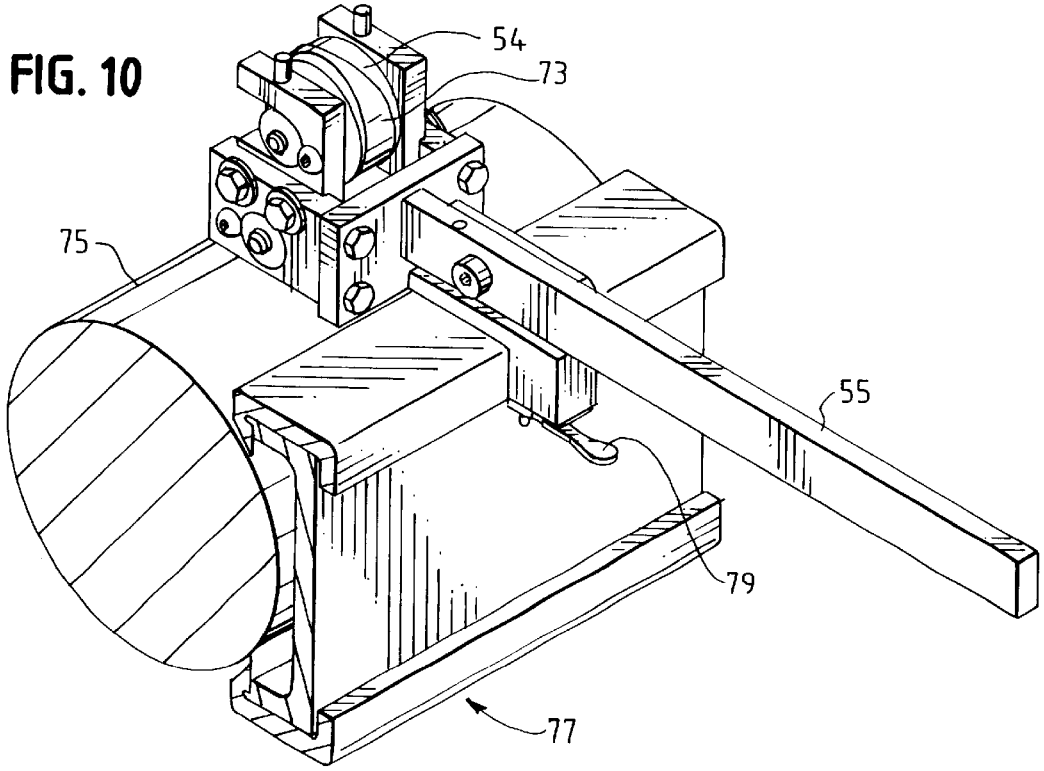
FIG. 10 is a fragmentary rear perspective view showing the device of FIG. 6 pressed against an anilox roll.
Figure 11:
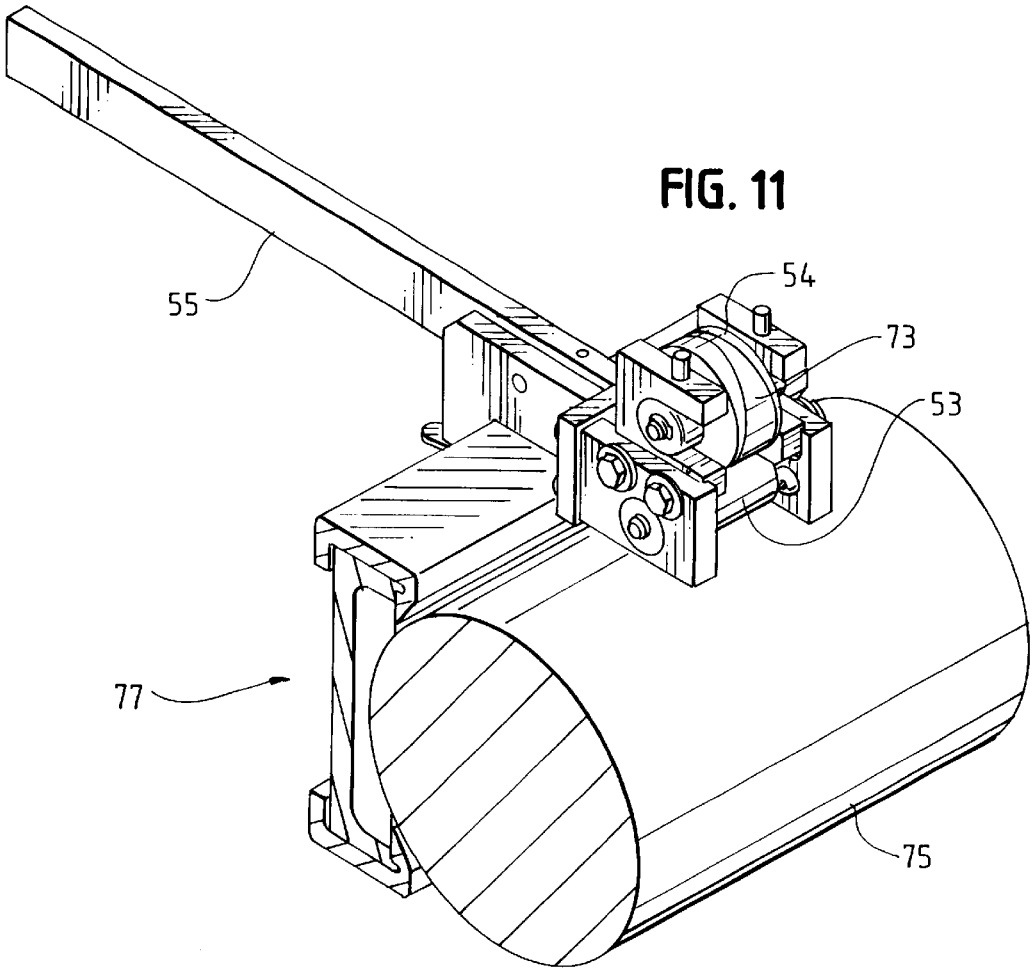
FIG. 11 is a front perspective view similar to FIG. 10.
Figure 12:
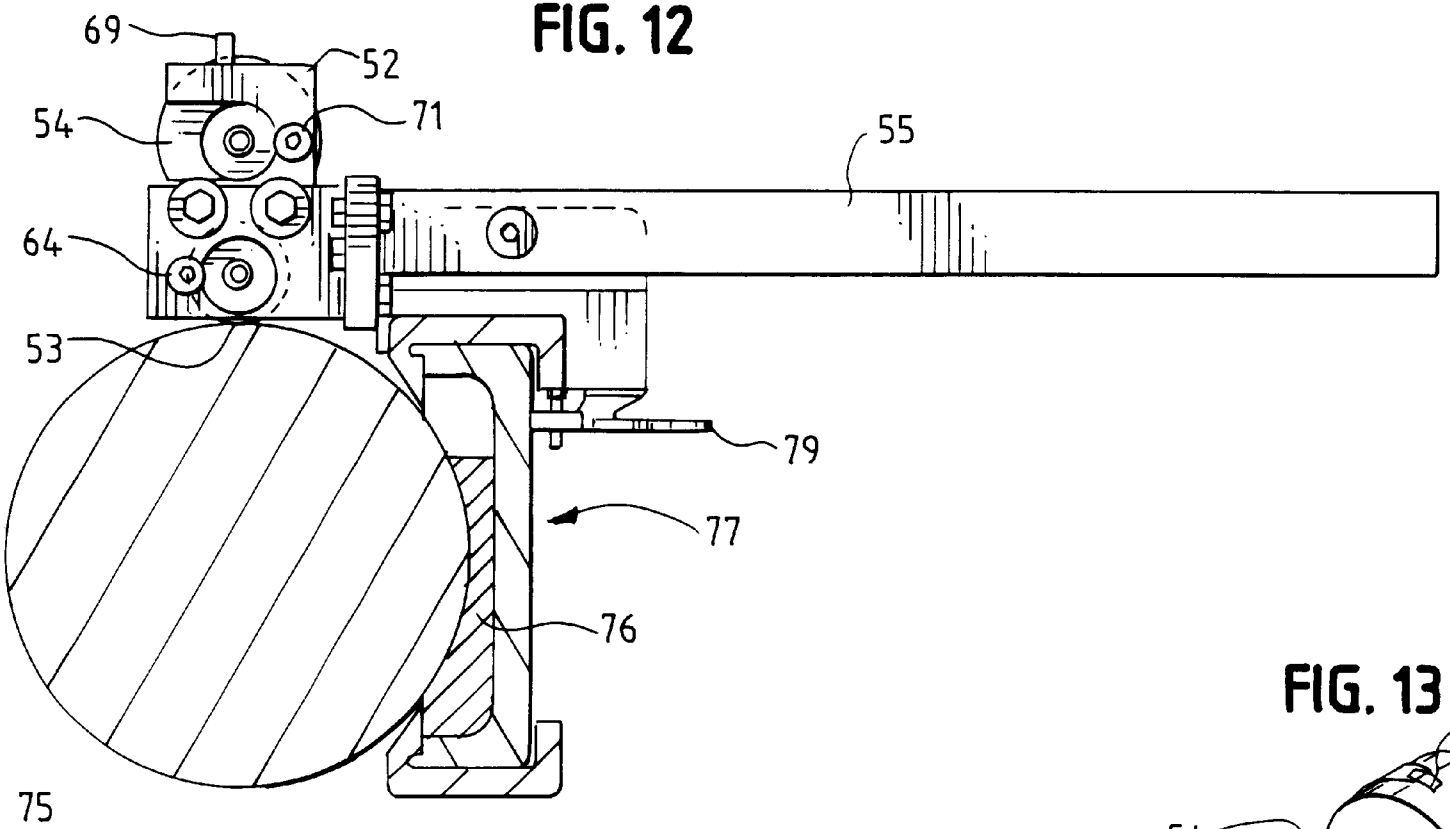
FIG. 12 is a side elevational view of the structure of FIG. 10.

FIGS. 10–12 illustrate the plate roll 53 being pressed against an anilox roll 75 which is being rotated by the Sunday drive. The anilox roll is wetted with ink 76 (FIG. 12) which is contained in a conventional doctor blade assembly 77. As the plate roll contacts the rotating anilox roll, the plate roll is caused to rotate. Rotation of the plate roll 53 will cause rotation of the strip 73 of web material and the impression roll 54. The rotating plate roll will pick up ink from the anilox roll and will transfer the ink to the strip 73 in a manner very similar to the way in which the web will be printed in the press. FIG. 13 illustrates the strip printed with ink 78.

Just before the entire strip 73 is printed, the device is removed from the anilox roll, and the ink which has been printed on the strip is inspected. For example, a color densitometer can be used to gauge color matching and color density. The balance, hue and other characteristics of the printed ink can also be inspected using other well know devices.

Any adjustments to the ink can be made while the anilox roll and ink system are in the staging area if the press includes a staging area or on the press before the job is started. Since the ink sample which is printed on the strip 73 is transferred from the actual ink handling system and anilox roll which will be used on the press, the sample will closely match the ink which will be printed during the actual press run.

The impression roll 54 is designed for quick and easy removal from the frame 52 so that a number of impression rolls can be wrapped with strips of web material. Another ink sample can be printed simply by removing the first impression roll from the frame, wiping the ink from the plate roll 53, and inserting a new impression roll in the frame.

A toggle clamp 79 is mounted on the handle 55 and can be used to clamp the sampling device to the doctor blade assembly as illustrated in FIGS. 10–12.

Figure 14:
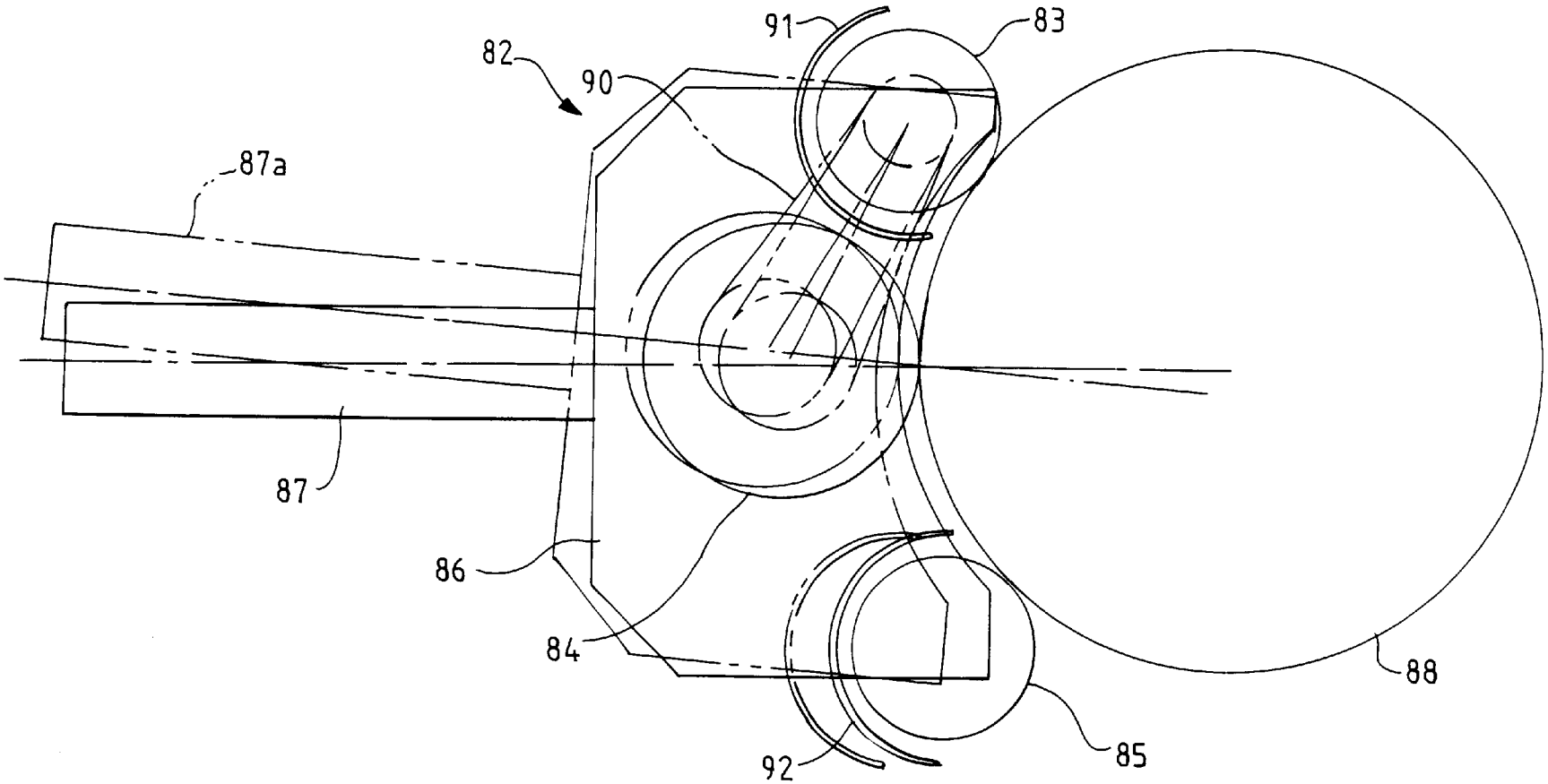
FIGS. 14–17 are side elevational views of other embodiments of ink sampling devices in accordance with the invention.

FIG. 14 illustrates a three roll sampling device 82 which includes top roll 83, middle roll 84, and bottom roll 85 which are rotatably mounted in frame 86. A handle 87 is attached to the frame. Before the device is held against an anilox roll 88, a sample strip of web material is woven between the top and middle rolls 83 and 84, around the front of middle roll 84, and between the middle and bottom rolls 84 and 85. Most of the web material is above the top roll. The top roll 83 and the middle roll 84 are connected by a belt 90 so that rotation of the top roll causes rotation of the middle roll.

The user presses the top roll 83 against the rotating anilox roll to bring the middle roll 84 up to speed. The spring loaded bottom roll 85 is brought against the anilox roll for alignment and control. When the rolls are at speed and aligned, the operator lowers the handle 87 from the position illustrated in phantom at 87*a* to the position illustrated in solid outline to bring the web on the outside of the middle roll into contact with the anilox roll. When the strip of web material is nearly expired, the operator relieves the handle pressure to stop feeding the web. Color information can be taken from the sample web.

Shields 91 and 92 are included in this design to protect the sample web from contacting the top and bottom rolls, which will have ink on them. The top and bottom rolls will need to be cleaned after each use.

Figure 15:
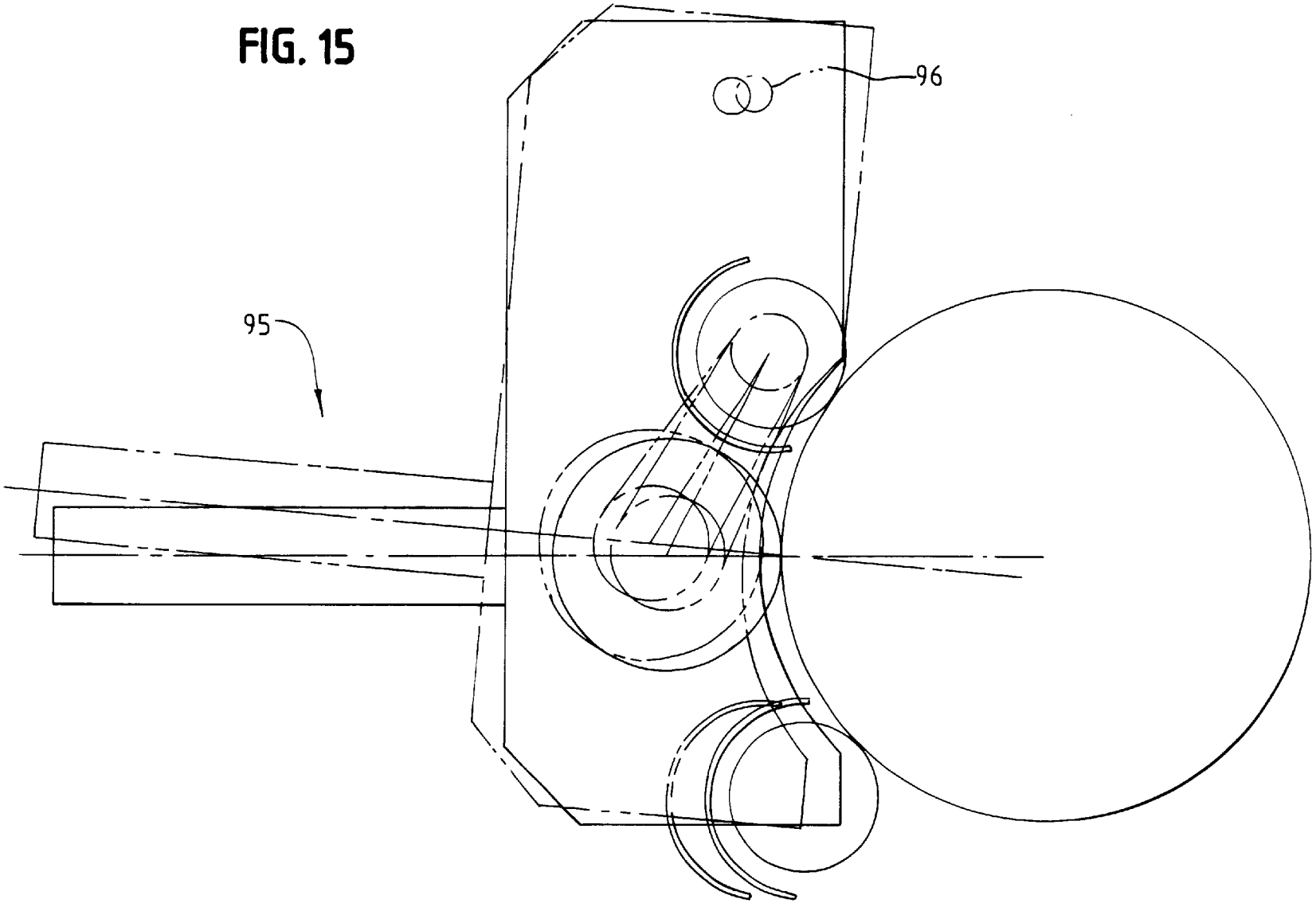

FIG. 15 illustrates another device 95 which is similar to the device of FIG. 14 except that a pin 96 is provided as a mounting point for the web sample which is wrapped into a small parent roll. With this design, a flat spring could be added to the web path for controlling web tension.

Figure 16:
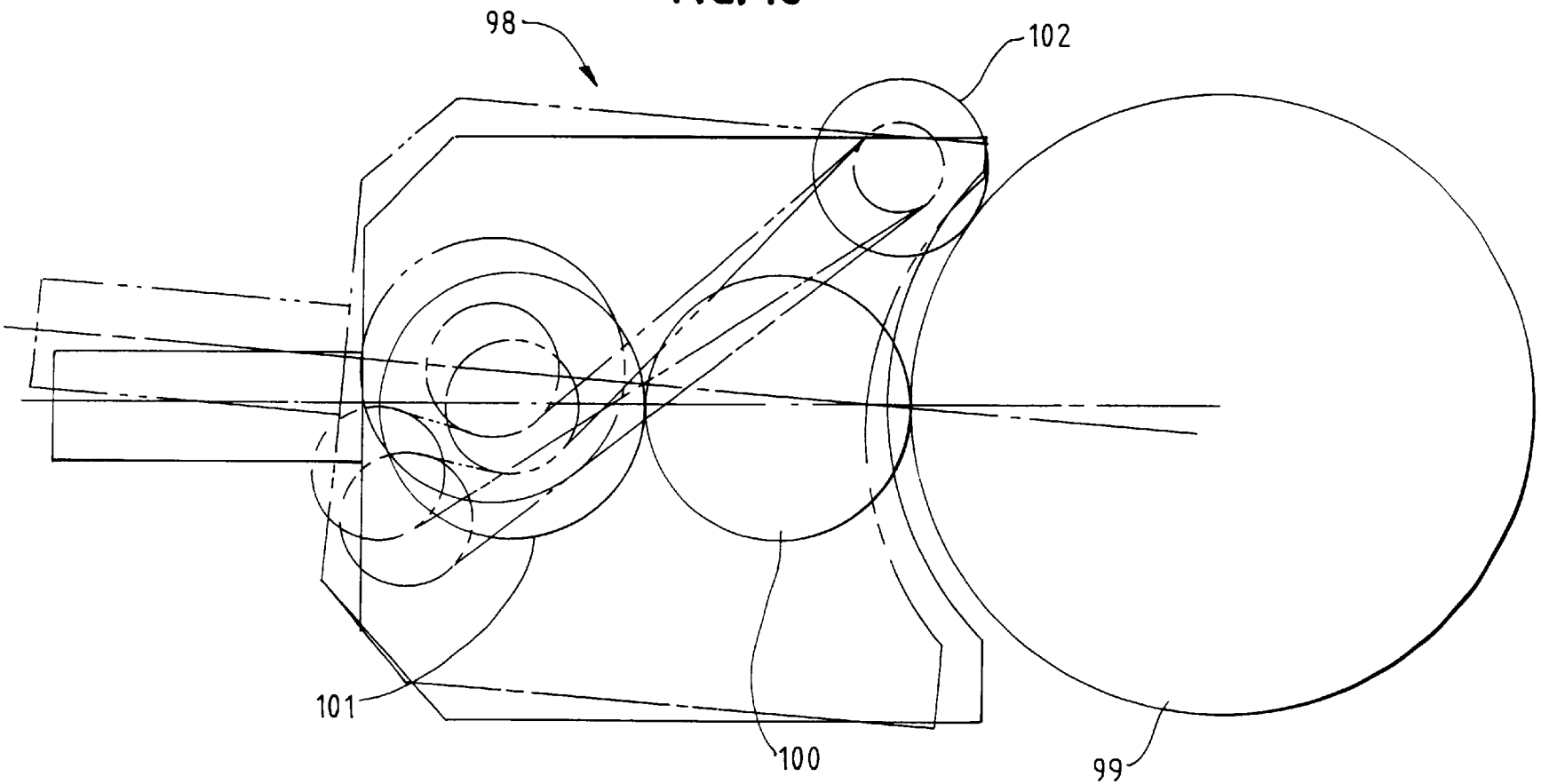

FIG. 16 illustrates another embodiment of a device 98 in which ink is transferred from anilox roll 99 to a middle roll 100, which resembles a plate cylinder in function. The web is inserted into the nip between middle roll 100 and left roll 101. This provides an advantage in that the ink path resembles the ink path of a running flexo press. Alternately, a pin could be added to this variation so that a roll of web material could be suspended from it and the web played out between the rolls. A flat spring break could be added to the system to control web tension. An upper roll 102 also contacts the anilox roll.

Figure 17:
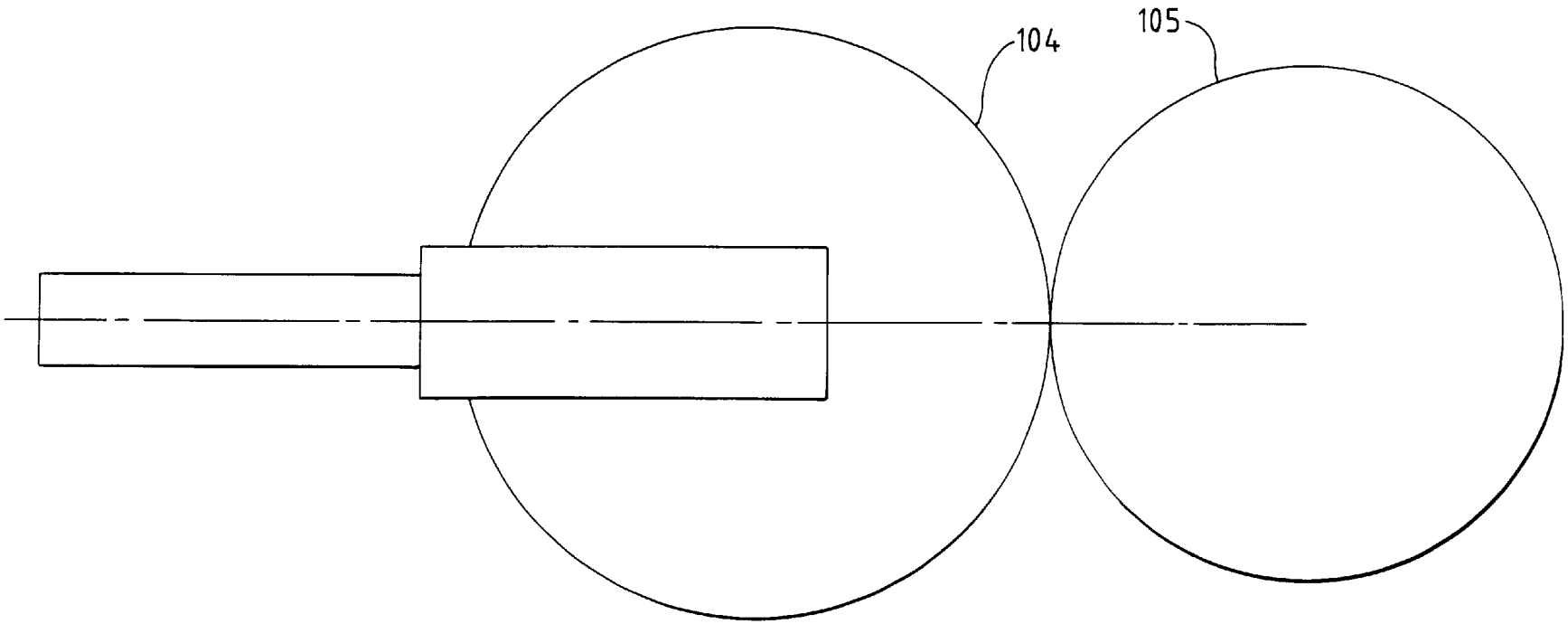

In FIG. 17 a large diameter roller 104 has a web sample taped to its surface. As the roller is brought into contact with anilox roll 105 near the leading edge of the sample, ink is transferred to the web. As the end of the sample approaches, the roller is removed from the anilox roll.

If the roller is eight inches in diameter, there will be essentially 25 inches of web to accelerate the roll, get a valid sample, and remove the roll from the anilox. This design has the advantage of simplicity and low cost. Since only the web contacts the anilox roll, only minimal clean up will be required. This design lacks alignment features and a direct method to accelerate the device's roller.

While in the foregoing specification a detailed description of specific embodiments of the invention was set forth for the purpose of illustration, it will be understood that many of the details hereingiven can be varied considerably by those skilled in the art without departing from the spirit and scope of the invention.

I claim:

1. A method for sampling printing ink for a printing press comprising the steps of A) providing a printing press comprising a plate cylinder, an impression cylinder, an anilox roll, and an inking system for the anilox roll;

B) providing an auxiliary drive for the anilox roll;

C) providing a separate subassembly not forming part of the printing press, the separate subassembly comprising a plate cylinder and an impression cylinder for use with the anilox roll of the printing press;

D) using the auxiliary drive to rotate the anilox roll and to pick-up ink from the inking system and coat the anilox roll of the printing press, with the anilox roll not engaged with the plate cylinder and impression cylinder of the printing press;

E) engaging the anilox roll with the plate cylinder of the separate subassembly, whereby the frictional contact of the rotating anilox roll with the plate cylinder of the separate subassembly causes the plate cylinder of the separate subassembly to rotate;

E) providing a substrate to be printed on between the plate cylinder and the impression cylinder of the separate subassembly;

G) printing on the substrate via the anilox roll and the plate cylinder and impression cylinder of the separate subassembly;

H) inspecting the printed substrate of step G to determine if the print is of acceptable quality;

aa) if the quality is acceptable, disengaging the separate subassembly from the anilox roll, then engaging the anilox roll with the plate cylinder of the printing press and printing, or bb) if the quality is not acceptable, adjusting the ink, and repeating steps F–H until the print quality is acceptable.

2. The method of claim 1 including the step of mounting the anilox roll and the inking system in a staging area separate from the printing press before performing steps B–G, and step H aa includes the step of moving the anilox roll and the inking system to the printing press before said step of engaging the anilox roll with the plate cylinder of the printing press.

3. The method of claim 1 in which the substrate is removed from a web which is to be printed on the press.

4. The method of claim 1 in which said substrate is taped to the impression cylinder of the separate subassembly.

* * * * *